US008746489B2

(12) United States Patent
Boehler et al.

(10) Patent No.: US 8,746,489 B2
(45) Date of Patent: Jun. 10, 2014

(54) EASY-OPEN CONTAINER AND CONTAINER COATING

(75) Inventors: Paul Boehler, Uetikon (CH); Raffaele Martinoni, Wolfhausen (CH)

(73) Assignee: Valspar Sourcing, Inc., Minneapolis, MN (US)

( * ) Notice: Subject to any disclaimer, the term of this patent is extended or adjusted under 35 U.S.C. 154(b) by 84 days.

(21) Appl. No.: 12/995,958

(22) PCT Filed: Jun. 1, 2009

(86) PCT No.: PCT/US2009/045783

§ 371 (c)(1), (2), (4) Date: Feb. 14, 2011

(87) PCT Pub. No.: WO2009/148988

PCT Pub. Date: Dec. 10, 2009

(65) Prior Publication Data

US 2011/0127268 A1 Jun. 2, 2011

Related U.S. Application Data

(60) Provisional application No. 61/058,296, filed on Jun. 3, 2008.

(51) Int. Cl.

| | |
|---|---|
| ***B65D 6/14*** | (2006.01) |
| ***B65D 8/22*** | (2006.01) |
| ***B65D 43/08*** | (2006.01) |
| ***B65D 41/44*** | (2006.01) |
| ***B65D 6/32*** | (2006.01) |

(52) U.S. Cl.

USPC ..... 220/359.4; 220/612; 220/677; 220/678; 220/680; 220/62.22; 220/62.12; 220/62.13; 413/18; 413/7; 413/2; 413/4; 413/5

(58) Field of Classification Search

USPC ..... 220/612, 359.4, 677–680, 62.22, 62.12, 220/62.13, 62.11; 413/18, 7, 2, 4, 5, 27, 26; 53/416; 428/418, 457, 458, 461; 525/64, 65, 68, 285, 284

See application file for complete search history.

(56) References Cited

U.S. PATENT DOCUMENTS 3,807,332 A * 4/1974 Okubo et al. ..... 413/1
3,932,368 A * 1/1976 McConnell et al. ..... 525/285

(Continued)

FOREIGN PATENT DOCUMENTS

AU 638092 8/1991
EP 0078625 A1 5/1983

(Continued)

OTHER PUBLICATIONS

International Search Report and Written Opinion for corresponding International Application No. PCT/US2009/045783 mailed on Nov. 20, 2009 (18 pages).

*Primary Examiner* — Fenn Mathew
*Assistant Examiner* — Jennifer Castriotta
(74) *Attorney, Agent, or Firm* — Brian R. Morrison; Westman, Champlin & Koehler P.A.

(57) ABSTRACT

The present application provides a container, such as a metal or plastic can, that has a rim with an integral heat seal zone (26) and a heat sealable powder or hot melt coating (42) applied to the heat seal zone (26) of the upper rim. In another embodiment, the container includes: a sidewall having an upper rim, wherein the upper rim includes an upwardly inclined and integrally formed heat seal zone (26); a heat sealable coating (42) applied to the heat seal zone (26) of the upper rim; and a peelable foil lid (30) removably attached to the heat seal zone (26) of the upper rim.

15 Claims, 3 Drawing Sheets

(56) References Cited

U.S. PATENT DOCUMENTS

| | | | | |
|---|---|---|---|---|
| 4,012,270 | A | 3/1977 | Fitko | |
| 4,370,369 | A | 1/1983 | Bonis | |
| 4,382,525 | A * | 5/1983 | Kobayashi et al. | 220/678 |
| 4,384,657 | A * | 5/1983 | Ueno et al. | 220/62.17 |
| 4,387,830 | A * | 6/1983 | Kitamura et al. | 220/495.03 |
| 4,501,375 | A | 2/1985 | Katsura et al. | |
| 4,735,835 | A * | 4/1988 | Taira et al. | 428/35.8 |
| 4,865,882 | A * | 9/1989 | Okano et al. | 427/195 |
| 4,946,895 | A * | 8/1990 | Ohmae et al. | 525/75 |
| 5,152,418 | A | 10/1992 | Kroeschell et al. | |
| 5,387,653 | A * | 2/1995 | Merval et al. | 525/420 |
| 5,413,244 | A * | 5/1995 | Ramsey | 220/671 |
| 5,725,120 | A * | 3/1998 | Ramsey et al. | 220/276 |
| 5,752,614 | A | 5/1998 | Nelson et al. | |
| 5,958,531 | A | 9/1999 | Stevenson | |
| 6,306,934 | B1 * | 10/2001 | Bode et al. | 523/412 |
| 6,601,727 | B2 | 8/2003 | Sauer et al. | |
| 6,680,082 | B2 * | 1/2004 | Chou et al. | 427/220 |
| 6,790,508 | B2 | 9/2004 | Raseti | |
| 6,933,055 | B2 | 8/2005 | Share et al. | |
| 7,118,800 | B2 | 10/2006 | Shirane et al. | |
| 7,168,581 | B2 | 1/2007 | Robinson et al. | |
| 7,174,762 | B2 | 2/2007 | Turner et al. | |
| 7,314,669 | B2 | 1/2008 | Galloway | |
| 7,651,779 | B2 | 1/2010 | Sato et al. | |
| 2003/0062370 | A1 * | 4/2003 | Ball et al. | 220/359.2 |
| 2005/0109784 | A1 * | 5/2005 | Varadarajan | 220/359.1 |
| 2006/0191940 | A1 * | 8/2006 | Heyn | 220/359.1 |
| 2007/0082151 | A1 * | 4/2007 | Hatano et al. | 428/35.7 |

FOREIGN PATENT DOCUMENTS

| | | | |
|---|---|---|---|
| EP | 0362020 | A1 | 4/1990 |
| EP | 0440550 | A1 | 8/1991 |
| EP | 0447563 | A1 | 9/1991 |
| EP | 0529336 | A1 | 3/1993 |
| EP | 0683110 | A1 | 11/1995 |
| EP | 0700838 | A1 | 3/1996 |
| EP | 0806370 | A1 | 11/1997 |
| EP | 1747826 | A1 | 1/2007 |
| GB | 2244254 | A | 11/1991 |
| WO | 9300403 | A1 | 1/1993 |
| WO | 02059186 | A1 | 8/2002 |
| WO | 02068196 | A1 | 9/2002 |
| WO | 03006329 | A2 | 1/2003 |
| WO | 2006000773 | A1 | 1/2006 |
| WO | 2006092364 | A2 | 9/2006 |

* cited by examiner

EASY-OPEN CONTAINER AND CONTAINER COATING

CROSS REFERENCE TO RELATED APPLICATION

This application is the National Stage filing under 35 U.S.C. 371 of International Application No. PCT/US2009/045783 filed on Jun. 1, 2009, which claims priority to U.S. Provisional Application Ser. No. 61/058,296 filed on Jun. 3, 2008, both entitled "Easy-Open Container and Container Coating," each of which is incorporated herein by reference in its entirety.

TECHNICAL FIELD

This invention relates to easy-open containers.

BACKGROUND

The packaging industry has long sought improved containers that safely protect and contain the contents while at the same time allowing the end-user to easily open the container to remove the contents. An example of an "easy-open" container is a three-piece metal can having a scored metal end that can be ripped by the end-user. Unfortunately, these easy-open ends are quite costly, and the scored metal end creates sharp edges when opened. As a result, the containers are not suitable for all uses, e.g., drinking from such a container would be potentially dangerous due to the sharp edges.

Plastic containers with easy-open plastic or metal foil lids have been introduced to fairly wide acceptance. These containers work very well for a variety of end uses; however, they cannot always be used for certain types of contents or in certain extreme processing conditions.

What is needed is an economical container that is easy to open, while not suffering the disadvantages of the existing containers.

SUMMARY

In one embodiment the present invention provides a container, such as a metal or plastic can, that has a rim with an integral heat seal zone. A heat sealable powder or hot melt coating is preferably applied to at least a portion of the heat seal zone of the upper rim.

In another embodiment, the present invention provides a container, such as a metal or plastic can, that includes: a sidewall having an upper rim, wherein the upper rim includes an upwardly inclined and integrally formed heat seal zone; a heat sealable coating applied to at least a portion of the heat seal zone of the upper rim; and a peelable foil lid removably attached to the heat seal zone of the upper rim.

In another embodiment, the present invention provides a heat-sealable polymer (such as, for example, a powder or hot-melt composition) that is applied to at least a portion of the rim of a container and optionally (e.g., in the case of a welded metal can body) along the inner weld zone of the can body.

In another embodiment, the present invention provides a heat sealable polymer that is applied to the rim of a container.

In another embodiment, the present invention provides a method, including the steps of: providing a container body having a sidewall having an upper rim, wherein the upper rim includes an integrally formed heat seal zone; and applying a heat sealable powder (or hot melt) coating to at least a portion of the heat seal zone of the upper rim.

The above summary of the present invention is not intended to describe each disclosed embodiment or every implementation of the present invention. The description that follows more particularly exemplifies illustrative embodiments. In several places throughout the application, guidance is provided through lists of examples, which examples can be used in various combinations. In each instance, the recited list serves only as a representative group and should not be interpreted as an exclusive list.

DETAILED DESCRIPTION OF THE PREFERRED EMBODIMENTS

The present invention relates to easy-open containers, such as, for example, metal or plastic cans and packages. The following description is primarily illustrated in the context of a metal can, though this invention has broader applicability.

Metal cans used in the food and beverage industry are typically categorized as being either "two-piece" cans or "three-piece" cans. A typical two-piece can has a can body (which resembles a cup, i.e., a cylinder having an integral bottom) and a separate "top" piece or "lid." The top piece is typically attached to the body during the filling process. A typical three-piece can has a top piece, a cylindrical body piece, and a bottom piece. Typically either the top or bottom piece is attached to the body during the can fabrication process, and the remaining piece is attached during the filling process. In some cases, the top piece may itself be made up of sub-pieces. For example, in some cans the top piece includes a riveted tab for opening the top along a score line. In other cases, a top piece has been made comprising a ring of metal to which a foil has been sealed.

Figure 1:
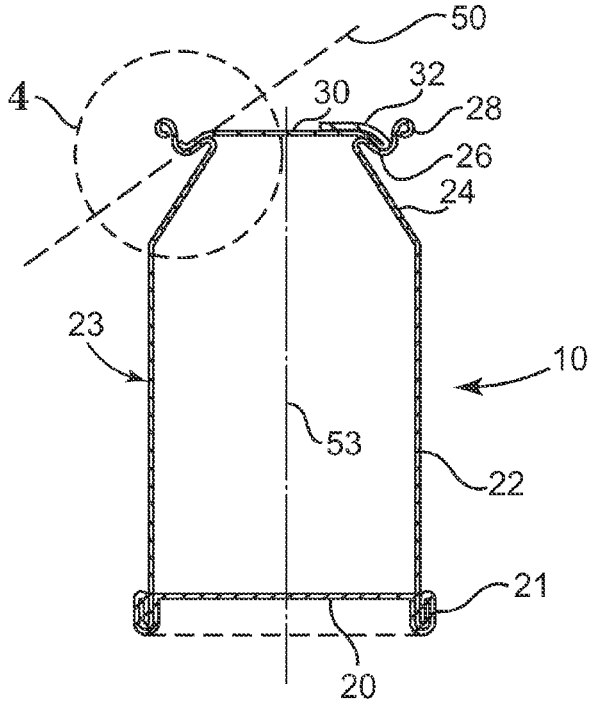
FIG. 1 illustrates a side view of a "three-piece" container of the present invention, with reference lines for the center axis of the container and for the heat seal zone plane.

FIG. 1 illustrates a side view of a "three-piece" container 10 of the present invention, with reference lines for the center-line axis 53 of the container and for the slope 50 of a major portion 26*a* of the heat seal zone 26. The container 10 includes a bottom portion 20 (also called the "end"), a body portion 23 (comprising a sidewall 22 and optional upper neck portion 24), and an easy open foil lid 30. The lid 30 preferably includes one or more tabs 32 to facilitate peeling off of the lid away from the heat seal zone 26 of the body. As shown, the body 23 has been necked towards the center-line 53 near the top of the can to form an upper neck portion 24, and the upper rim of the can has been rolled to form an outer rim curl 28, so that no sharp edges of the metal are exposed. The bottom of the sidewall 22 is seamed to the bottom 20, to form a bottom seal 21. Typically, when two pieces of metal are joined a sealant compound (not shown) may be used. As illustrated in FIG. 1, outer rim curl 28 may in some preferred embodiments lie above the top plane of the container (e.g., slightly above inner rim 40 and above foil lid 30 and tab 32). In this configuration, stacking of the containers can be accomplished without causing the bottom of the top container to rub against the foil. In preferred embodiments, the rim curl will be 0.1 to 0.3 mm higher than the foil lid 30 and tab 32.

Figure 2:
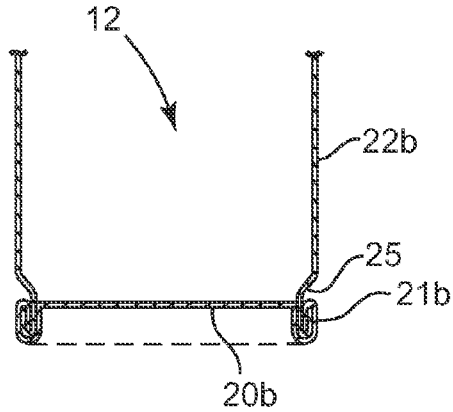
FIG. 2 illustrates the bottom portion of an alternative "three-piece" container of the present invention.

FIG. 2 illustrates the bottom portion of an alternative "three-piece" container 12 of the present invention. In this embodiment, the body includes the sidewall 22*b* and a bottom neck portion 25. The sidewall 22*b* and bottom end 20*b* are seamed via a bottom seal 21*b*.

Figure 3:
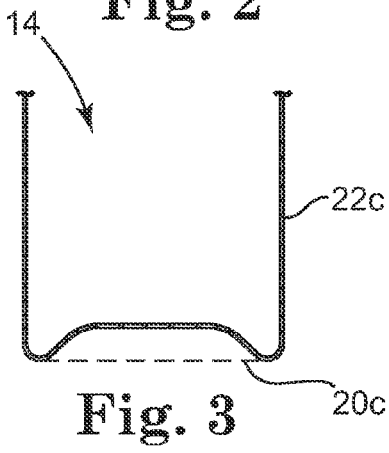
FIG. 3 illustrates the bottom portion of an alternative "two-piece" container of the present invention.

FIG. 3 illustrates the bottom portion of an alternative "two-piece" container 14 of the present invention. In this embodiment, the body includes an integral sidewall 22*c* and bottom 20*c*. Though not shown, the bottom portion of a two-piece container may also be necked and the body shaped, if desired.

Figure 4:
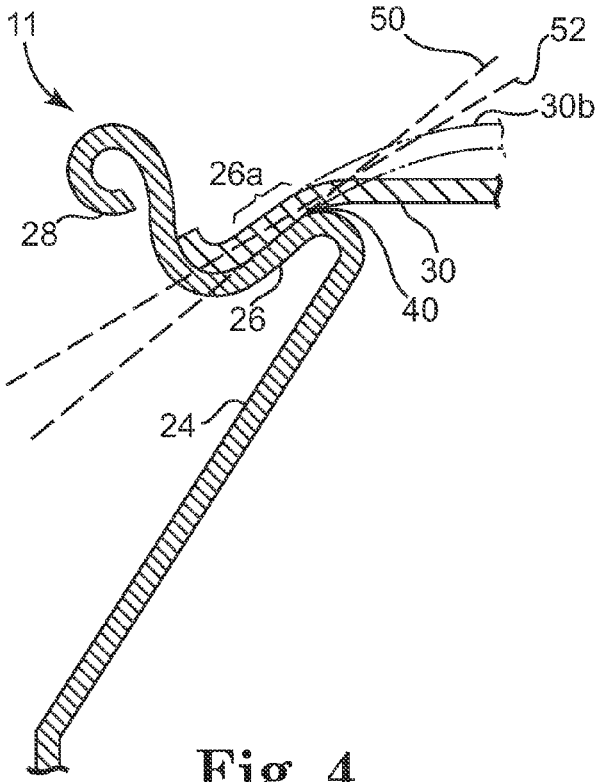
FIG. 4 illustrates the top left portion of the container of FIG. 1, with reference lines for the heat seal zone plane and also phantom lines for the foil lid when the lid is expanded under pressure.

FIG. 4 illustrates the top left portion 11 of the container of FIG. 1. In this illustration, the foil lid 30 is shown in its un-pressurized state and using phantom lines as it might appear under pressure. See 30*b*. Reference line 50 is approximately parallel to a major portion 26*a* of the heat seal zone 26. Reference line 52 is approximately parallel the hoop stress of the foil near the inner rim 40. As illustrated in FIG. 4, the slope of the heat seal zone portion 26*a* (i.e., reference line 50) is preferably upwardly inclined (as viewed from the perimeter towards the container centerline) and more preferably steeper than the slope of the hoop stress (i.e., reference line 52). While not intending to be bound by theory, it is believed that having such an arrangement will lessen the chances that the foil lid will peel away from the rim when the foil lid is under pressure. The length of the heat seal zone should be sufficient to permit a robust and complete seal of the lid to the container body. In preferred embodiments, the length is at least 2 mm, more preferably at least 3 mm, and most preferably 3 to 5 mm. If desired, the lid may be attached using a first heat seal ring and a second heat seal ring around the first. In that way, any leaks in the first seal will be contained by the second seal.

Figure 5:
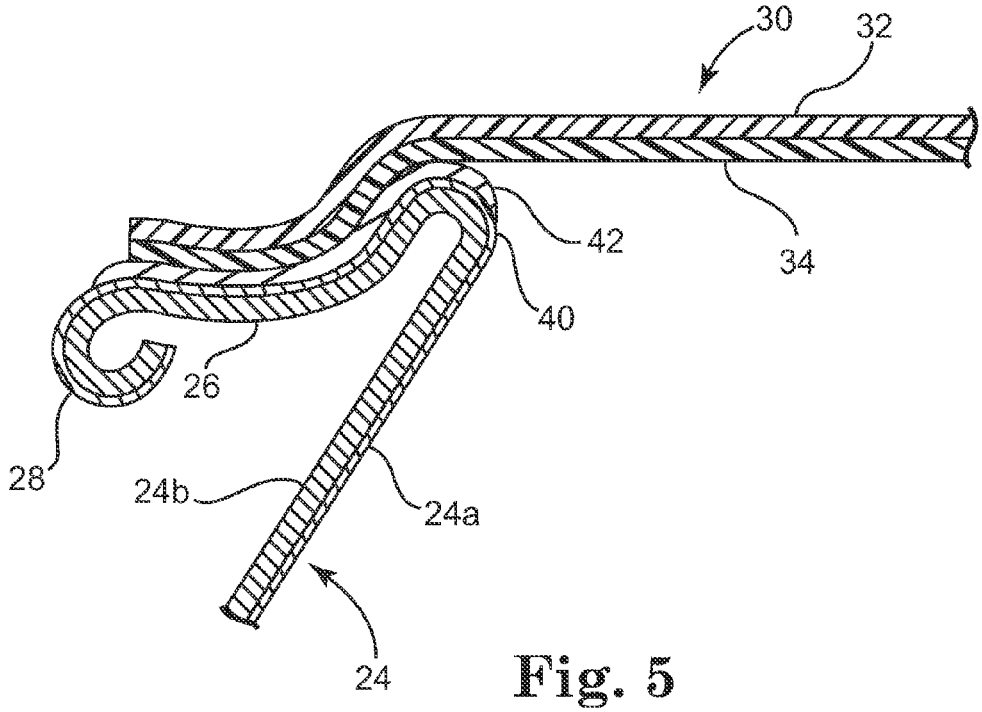
FIG. 5 illustrates an alternative top left portion of the container.

FIG. 5 illustrates an alternative top left portion of the container and further details the structure of the foil lid 30 and neck 24 region of the container. As illustrated in FIG. 5, the foil lid 30 comprises backing layer 32 and heat seal layer 34; and the container sidewall comprises a support layer 24*b* (e.g., a metal layer) and an inner food contact layer 24*a* (e.g., a coating or lacquer). In contrast to the embodiment illustrated in FIG. 1, outer rim curl 28 lies below the inner rim 40, though having the rim curl lie above the inner rim has certain advantages as noted herein. Though not shown, it is within the scope of the present invention to utilize a plastic cap to cover and protect the foil (or for resealable use). Such a cap can be manufactured to snap onto the rim of the can.

In one embodiment, heat seal layer 34 comprises polypropylene. Other suitable heat seal layer materials are discussed elsewhere in this document. One or more heat sealable coatings 42 is applied to the heat seal zone 26. The heat sealable coating is preferably a powder coating (or a "hot melt" coating) that is optionally applied to the heat seal zone after the container is formed. In another embodiment, the heat sealable coating is applied to the entire inside surface of the container body (e.g., as a liquid coil or sheet coating composition). In the case of three-piece containers, any weld areas of the container body are covered with additional heat sealable coating at least in the region of the heat seal zone.

Figure 6:
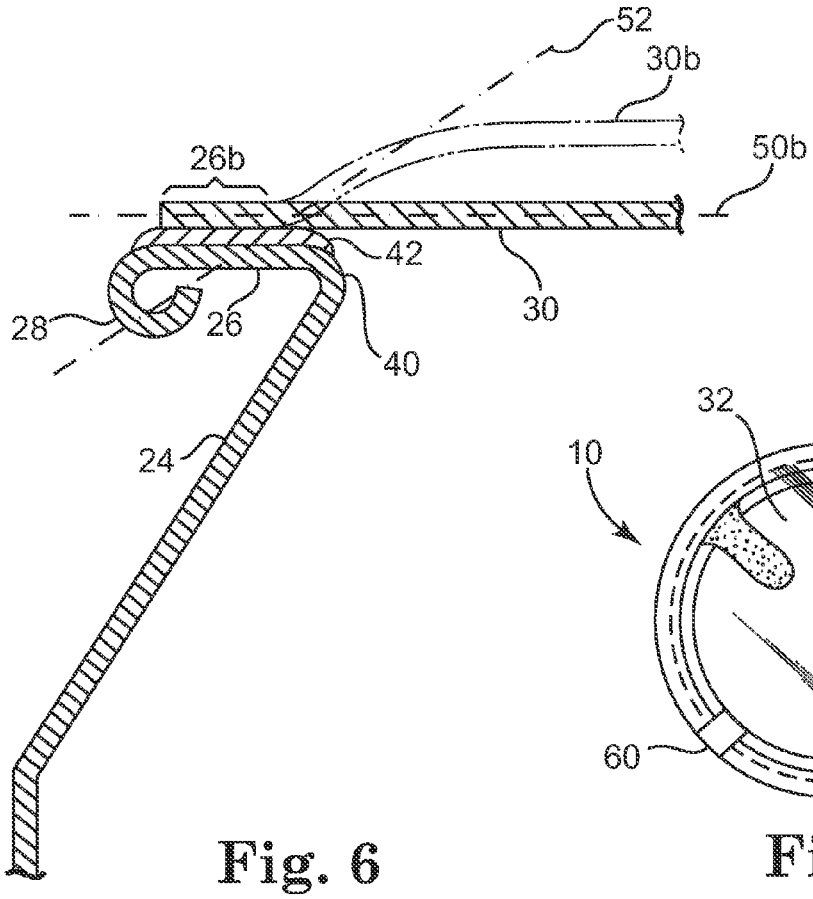
FIG. 6 illustrates the top left portion of an alternative container, with reference lines for the heat seal zone plane and also phantom lines for the foil lid when the lid is expanded under pressure.

FIG. 6 illustrates the top left portion of an alternative container. In this illustration, the foil lid 30 is shown in its un-pressurized state and using phantom lines as it might appear under pressure (see 30*b*). Reference line 50*b* is approximately parallel to a major portion 26*b* of the heat seal zone 26. Reference line 52 is approximately parallel the hoop stress of the foil near the inner rim 40. In FIG. 6 the slope of the hoop stress (i.e., reference line 52) is steeper than the slope of the heat seal zone portion 26*b* (i.e., reference line 50*b*). However, the peel forces are still less than that which would be present in situations where the major portion 26*b* is itself angled downward. It should be noted, that in some embodiments, the container is initially provided in a form having a generally horizontal slope for the major portion 26*b* of the heat seal zone 26, and that during or after the heat sealing process (preferably during) the heat seal zone is deformed so as to have an upwardly inclined slope as illustrated in FIG. 4.

Figure 7:
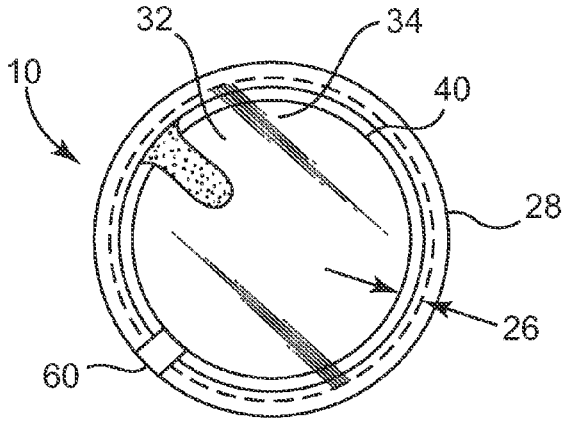
FIG. 7 illustrates a top view of a container of the present invention.

FIG. 7 illustrates a top view of a container 10 of the present invention. In this embodiment, the container has a round profile, though it will be appreciated that oval, rectangular or other shapes may be used. The sidewall of the container has been formed so as to have an integral outer rim curl 28 and inner rim 40. A heat seal zone 26 provides a region for the foil lid to be removably attached to the container body. As illustrated in FIG. 7, the container has a weld zone 60, which is coated at least at the heat seal zone 26 with a heat sealable coating. The foil lid 32 is shown with a single tab 34, though the container might have more than one tab or the entire periphery of the foil lid could extend past the heat seal zone to enable removal of the foil lid.

Figure 8:
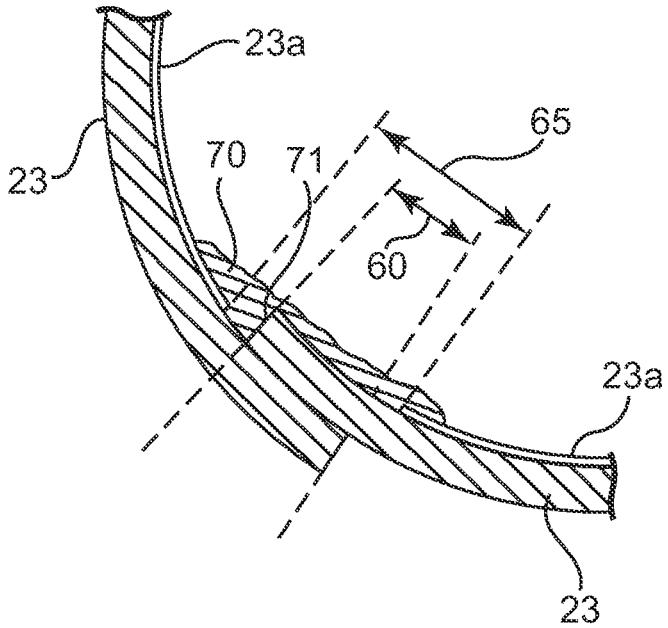
FIG. 8 illustrates a partial top cross-sectional view of the sidewall of a welded three-piece container of the present invention.

FIG. 8 illustrates a partial top cross-sectional view of the sidewall of a welded three-piece container of the present invention. In this view, details of the welded portion of the sidewall are depicted. Sidewall 23 has a coating 23*a* on its inside major surface. That coating is typically removed or not present on a portion of the sidewall near the weld. When the sidewall is welded to form a cylinder, an overlap 60 is typically created, though a butt joint may be employed in some processes. In one common method of welding, resistance welded seams are formed having overlap of approximately 0.5 to 0.8 mm. In any event, a bare metal zone 65 is present in the formed container body. This bare metal zone is coated using a suitable weld zone coating 70 as described herein. The coating preferably adheres to both bare metal and the sidewall coating 23*a*. In preferred embodiments the coating is a powder side stripe coating that extends 1 to 3 mm past the edge of coating 23*a*. In most preferred embodiments of the present invention, the weld zone coating 70 is applied at a sufficient thickness at least at the heat seal zone of the rim and near the step gap 71, to enable the heat seal layer of the foil to seal. While not intending to be bound by theory, it is believed that having too thin of a heat sealable coating at the step of the weld will cause undesired leakage to occur at that position. For metal thicknesses between about 100 and 200 microns, it is preferred to have a weld zone coating that is approximately at least 50 to 80 microns thick in the region of the overlap zone 60 and sufficiently thick to generally fill the step gap 71, so as to provide a smooth transition across the step gap. Lacquer applied coatings (e.g., solvent- or aqueous-based coatings) are typically only 8 to 15 microns thick when dried and would be too thin to fill the step gap of typical metal cans.

Any suitable foil lid material may be used in the present invention. (See, e.g., U.S. Pat. Nos. 6,790,508 and 7,118,800 for description of suitable foil lid materials.) Depending on the end use, the foil lid material will need to meet a variety of possible requirements, such as: containing the contents in the container, serving as a barrier to gasses or liquids, blocking harmful UV rays, etc. Consequently, the choice of lid material can vary depending on the requirements.

In one embodiment, the foil lid material comprises (i) one or more backing layers (e.g., paper, plastic, metal, etc.) and (ii) one or more heat seal layers on at least one major surface of the backing.

The backing layer or layers are typically designed to perform the structural requirements of the lid and specific choice of the most suitable backing layer will depend on those requirements. For example, a metal backing (e.g., aluminum foil) may be a good choice when one or more of strength, gas and/or liquid impermeability, and/or UV blocking are required. Some plastic backing materials are also suitable for these same requirements, though to achieve gas impermeability with a plastic backing generally requires the use of a specialty barrier material.

The backing may comprise multiple layers of different materials to achieve the desired overall properties needed for the particular lid. For example, a PET layer may be used adjacent a "barrier" plastic layer (see, e.g., U.S. Pat. No. 6,933,055 for description of suitable barrier materials). In this case the PET layer provides strength and low cost, while the barrier layer provides some degree of oxygen or $CO_2$ impermeability.

Typically, the backing will provide the lid material with sufficient heat resistance to (i) permit the heat sealing of the lid to a container, and (ii) withstand the temperatures the container is subject to (e.g., during processing and use conditions). For example, food containers are sometimes "hot filled." Consequently, preferred sealed lids are capable of withstanding temperatures of 100° C., more preferably at least 121° C., and most preferably at least 135° C.

Suitable heat seal layers include any materials that are capable of forming a seal with the heat sealable coating that is applied to the container rim.

Suitable heat seal layers include polymeric layers that are designed to melt at an appropriate heat seal temperature (e.g., 150 to 180° C., more preferably 160 to 170° C.). Suitable polymers include polyethylene (PE), ethylene vinyl acetate (EVA), polypropylene (PP), propylene ethylene copolymers (PPE), ethylene alpha-olefin copolymer, ethylene butyl acrylate copolymer (EBA), ethylene methacrylic acid copolymer (EMAA), ethylene acrylic acid copolymer (EAA), ethylene methyl acrylate copolymer (EMA), mixtures and copolymers of these materials, etc. A presently preferred heat seal layer material comprises polypropylene or propylene ethylene copolymers.

If desired, a delaminating heat seal layer system may be used, such as is described in U.S. Pat. No. 7,314,669 (see particularly layers 12 and 14 of that reference). In systems of this type, two layers are selected such that the user's peeling of the foil away from the container causes the first layer (12) and second layer (14) to delaminate in the vicinity of the heat seal area.

A heat sealable coating is preferably selected to provide a suitable surface against which the foil material may be heat sealed. Preferred heat sealable coatings "bridge-the-gap" between the foil and the container. In the case of a metal food or beverage can, for example, the heat seal coating provides adhesion to the metal sidewall and a ready surface for heat sealing with the foil.

Metal containers, such as food cans, are oftentimes coated with specialized coatings that protect the container against degradation over prolonged periods of time and in very harsh conditions. One such high performance food-contact coating is an epoxy coating. Unfortunately, a typical epoxy-based can coating used on the interior of food or beverage cans does not provide a surface that is adapted to the heat-sealing process and traditional heat seal foils simply do not adhere well to these coatings. To make such coatings suitable, one may add an adhesion promotion additive to the epoxy coating. One such additive is a PP or acid-modified PP material (e.g., MorPrime™, available from Rohm and Haas). The inclusion of a suitable additive helps render the packaging coating compatible with typical heat seal films.

The use of such coatings is within the scope of the present invention. In certain situations, the use of one of these coatings will be all that is required to provide a suitable heat seal zone on the containers of the present invention. However, as is described below, there are situations where the modified inside spray container coating will not be sufficient to meet the heat seal requirements, or where drawbacks to this approach will be outweighed by the alternative described herein. One drawback of using a modified inside spray is that the cost of the inside coating goes up unnecessarily, as most of the adhesion additive is in areas where it is not needed (i.e., away from the relatively small heat seal zone). In addition, the additive may negatively impact the performance of the container coating. Another situation that would make reliance on the modified inside coating unwarranted is that in the case of a three-piece can, where the inside coating is uncoated in the weld area. Since at least a portion of the heat seal zone is welded, the lid would be unable to heat seal in the region of the weld, thus causing a leak.

According to the present invention, the entire rim of the container in the heat seal zone has a suitable surface for heat sealing with the heat seal foil. This can be accomplished in several ways, including without limitation:

- Provide an additive in the inside coating of an unwelded can (e.g., a drawn can) to thereby make the entire coating around the rim acceptable to heat sealing;
- Provide an additive in the inside coating of a welded can and then place a powder or hot-melt coating on at least the heat seal portion of the weld, to thereby make the entire coating around the rim acceptable to heat sealing; or
- Use a traditional inside coating (i.e., a coating that is not suitable for heat sealing by itself) and then apply a powder or hot-melt coating on at least the heat seal portion of the rim, to thereby make the entire coating around the rim acceptable to heat sealing.

Alternatively, one may apply a spot applied coating to the interior side of a foil material that provides the properties to seal, and (for a three-piece can) to bridge the step gap in the welding area.

In one embodiment, the container is an unwelded metal can having an interior coating applied to the inside surface, wherein the coating has been formulated to include an efficacious amount of a PP or acid-modified PP additive. The upper portion of the can body is formed to include an upper rim that includes an integrally formed heat seal zone. The heat seal zone, with the modified interior coating applied thereto, is ready for use with a suitable heat seal lid material.

In another embodiment, the container is a metal can having a weld. The upper portion of the can body is formed to include an upper rim that includes an integrally formed heat seal zone. A powder or hot-melt coating is applied to the heat seal zone of the rim to thereby make the entire coating around the rim acceptable for use with a suitable heat seal lid material.

Suitable powder coatings or hot-melt coatings include thermoplastic coatings that adhere to the container (or a coating applied to the container) as well as that provide a suitable surface to which the heat seal layer of a foil lid may be heat sealed. Generally a suitable powder coating is a thermoplastic material that is ground into a suitable size powder, to facilitate application of the powder (e.g., by electrostatic spraying) to a substrate. The powder, when heated, melts to thereby form a film. Suitable hot-melt coatings can be made from the same or similar materials. However, rather than being applied as a powder to the substrate, the hot-melt coating is applied as a solvent free and melted liquid. Upon cooling the coating solidifies to form a film.

Preferred powder coatings have a mean particle size of between 20 and 150 microns, more preferably between 40 and 80 microns weight average.

Suitable materials from which to make the powder coating or the hot-melt coating include polymeric compositions containing one or more polymers such as acid-modified PP, blends of acid-modified PP with (i) one or more polyester polymers or copolymers (e.g., PBT, etc), or (ii) one or more epoxy or phenoxy resins, or (iii) blends of (i) and (ii).

One suitable powder coating was made by blending a PP material with a polyester material. These two types of materials are generally incompatible at a microscopic level. However, the blend was sufficiently compatible so as to permit the preparation of powder particles having both polyester and PP components. The polyester polymers have preferably a melting point that is substantially above (preferably 20° C. above) the food packaging or food processing temperature. This is to ensure that the coating has sufficient adhesion and bonding strength at the packing and food processing conditions. In some embodiments, one or more polyester polymers have a melting point of from about 120 to about 200° C., preferably from about 140 to about 180° C., and even more preferably from about 150 to about 170° C. Preferably, the polyester polymer is semi-crystalline. While not intending to be bound by any theory, it is also believed that in some embodiments it may be desirable to select one or more polyester polymers having a similar, or substantially similar, polarity to a PP component (more preferably similar to an acid-modified PP component).

Physical blends of two different powders may work as well, if the powders do not need to undergo too much deformation after the film formation. In preferred embodiments, at least one powder of the blend promotes adhesion to the substrate and at least one powder of the blend promotes adhesion to the PP foil. Preferably the two powders have a sufficient compatibility in the molten stage in order to form a melt that provides sufficient cohesion between the different particulates. Powder blends that have little cohesion between the different particulates may have limitations in regard to flexibility which is sometimes beneficial for side stripe powder application, where the sealing area needs to be shaped before the lid sealing. Moreover, incompatible PP-particulates may tend to pop out from the coating at the deformation stage.

Several illustrative powders were prepared as follows.

For direct metal applications on preformed metal we found that Fusabond P M613-05 internally ground to particle size of less than about 120 microns worked well. This material is a modified PP-powder from DuPont. This powder was also tried for side stripe on tinplate, but it was not flexible enough for the can body deformations. Moreover, it does not adhere well onto internal can coatings that do not have dispersed PP-particles incorporated therein.

For side stripe and rim coating application we found that Samples A, B, and C as per the following table (each coextruded and ground below 120 microns) worked well.

| Ingredient* | Sample A (parts by weight) | Sample B (parts by weight) | Sample C (parts by weight) |
|---|---|---|---|
| Fusabond P M613-05 | 12 | 25 | 22 |
| Tiona RCL 595 | 8 | 8 | 8 |
| Polyester A | 29 | 29 | — |
| Polyester B | 29.5 | 18.5 | — |
| Polyester C | — | — | 51 |
| Araldite GT 6810-1 | 9 | 9 | 9 |
| Blanc Fixe N | 5 | 5 | 8 |
| Al Silicate ASP 400 | 4 | 4 | — |
| Mica F | 3 | 3 | — |
| Perenol F P30 | 0.5 | 0.5 | — |
| Byk 366 | — | — | 1.5 |
| Irganox 1010 | — | — | 0.3 |

Polyesters A, B, C are modified polybutyleneterephtalate resins with the following properties:
Melting points: A = 170° C., B = 150° C., C = 150° C.; Glass transition temperature A = 25° C., B = −22° C., C = −22° C.; Number average molecular weight: A = 20,000, B = 20,000, C = 15,000; Shore Hardness D: A = 75°, C = 37°. Tiona RCL 595 is a $TiO_2$ pigment from Millenium; Mica F is a Glimmer pigment from Quarzwerke; ASP 400 is an aluminium silicate from Engelhard; Blanc Fixe N is a Bariumsulphate from Sachtleben; Perenol F P30 is an acrylic flow additive from Cognis; Byk 366 is an acrylic flow additive from BYK, Irganox 1010 is an antioxidans from CIBA.

Sample A had good flow, flexibility and adhesion before processing, but reduced adhesion onto metal after processing. The adhesion onto some packaging coatings without PP spiking was acceptable. Sample B had poor flow, limited flexibility and good adhesion before processing. In order to improve the adhesion of Sample A it is anticipated that one might substitute the acid-modified epoxy resin Araldit GT 6810-1 by a standard epoxy resin such as Araldite GT 6099 from Huntsman, or a low BADGE grade epoxy resin from Kukdo KD 6719.

In one embodiment the container is a "three-piece" container and the foil lid is attached to the upper portion of the container prior to attachment of the bottom. In this embodiment, the seal between the foil lid and the body can be assessed to make sure that a complete seal has been achieved. Such assessment can be done on a random sampling basis or on an every-can basis. The can is then inverted and filled through the bottom. The bottom end is then attached in the normal manner to enclose the contents therein.

In another embodiment, which is useable on either a three-piece or a two-piece container, the can minus the foil lid is filled with its contents and the foil lid is applied to close the container. Preferably, the heat sealable coating has been applied to the rim of the container (or to the foil) prior to the container being filled with the contents. In that manner, it is only necessary to heat seal the foil to the heat seal zone.

Containers of the present invention may be fitted with a "cap," not shown in the drawings, to protect the foil lid (or provide resealability of the container). Such caps may be made out of plastic, paper or other materials.

A number of embodiments of the invention have been described. Nevertheless, it will be understood that various modifications may be made without departing from the spirit and scope of the invention. Accordingly, other embodiments are within the scope of the following claims. The complete disclosure of all patents, patent applications, and publications are incorporated herein by reference as if individually incorporated.

The invention claimed is:

1. A container, comprising:

a metal sidewall having an upper rim and a welded seam extending to the upper rim, wherein the upper rim includes an integrally formed heat seal zone having an upwardly inclined portion with an incline that is steeper than a maximum angle of a foil lid when the foil lid is fully expanded under pressure;

a food-contact polymer coating applied on the upper rim and the sidewall except at the welded seam, such that the food-contact polymer coating has edges adjacent to the welded seam; and a coating system formed from a heat sealable thermoplastic powder comprising particles having a mean particle size ranging between 20 and 150 microns, which compositionally include an acid-modified polypropylene or a blend of an acid-modified polypropylene with (i) one or more polyester polymers, (ii) one or more epoxy or phenoxy resins, or (iii) blends of (i) and (ii), the coating system including:

a first coating applied to the heat seal zone of the upper rim after the upper rim has been formed, such that the applied first coating covers the food-contact polymer coating at the upper rim;

a second coating applied to the sidewall along the welded seam, such that the applied second coating covers the welded seam and the edges of the food-contact polymer coating.

2. The container of claim 1, wherein the heat sealable thermoplastic powder comprises, compositionally, the blend of the acid-modified polypropylene with the one or more polyester polymers, and the one or more epoxy or phenoxy resins.

3. The container of claim 1, wherein the second coating has a thickness of at least 50 microns at the weld seam.

4. The container of claim 1, wherein the foil lid is a peelable foil lid removably attached to the heat seal zone of the upper rim.

5. The container of claim 4, wherein the peelable foil lid comprises a layer of polypropylene or modified polypropylene.

6. The container of claim 1, wherein the food-contact polymer coating comprises an epoxy material.

7. The container of claim 1, wherein the container is a three-piece can having a bottom end that is attached to the sidewall.

8. The container of claim 1, wherein the metal sidewall is between about 100 and 200 microns thick and the second coating is applied at a sufficient thickness to bridge the step gap where the metal sidewall overlaps at the welded seam, thereby providing a gentle transition across the step gap.

9. The container of claim 1, wherein the container further comprises a bottom portion and wherein the bottom of a first container stacks against the top of a second container without damaging the foil lid of the second container.

10. The container of claim 1, wherein the bottom portion of the upper container of a two-container stacked pair does not rest against the peelable foil lid when the two containers are stacked.

11. The container of claim 1, wherein the heat seal zone is at least 3 millimeters wide.

12. A method, comprising the steps of:

providing a container body having a sidewall having an upper rim and a welded seam extending to the upper rim, wherein the upper rim includes an integrally formed heat seal zone;

applying an food-contact coating on the upper rim and the sidewall except at the welded seam, such that the food-contact polymer coating has edges adjacent to the welded seam;

applying a heat sealable thermoplastic powder comprising particles having a mean particle size ranging between 20 and 150 microns, which compositionally include an acid-modified polypropylene or a blend of an acid-modified polypropylene with (i) one or more polyester polymers, (ii) one or more epoxy or phenoxy resins, or (iii) blends of (i) and (ii) to at least a portion of the heat seal zone of the upper rim to form a first coating that covers the food-contact coating at the upper rim; and applying the heat sealable thermoplastic powder to the sidewall along the welded seam to form a second coating that covers the welded seam and the edges of the food-contact polymer coating;

heat sealing a peelable foil lid to the heat seal zone of the upper rim;

deforming the upper rim so as to create an upwardly inclined and integrally formed heat seal zone; and fully expanding the sealed peelable foil lid, wherein the upwardly inclined and integrally formed heat seal zone is steeper than a maximum angle of the expanded sealed foil lid.

13. The method of claim 12, wherein the step of applying the heat sealable thermoplastic powder to the sidewall along the welded seam forms the second coating at a sufficient thickness to bridge the step gap where the metal sidewall overlaps at the welded seam, thereby providing a gentle transition across the step gap.

14. The method of claim 12, wherein the food-contact polymer coating comprises an epoxy material.

15. The method of claim 12, wherein the heat sealable thermoplastic powder comprises the blend of the acid-modified polypropylene with the one or more polyester polymers, and the one or more epoxy or phenoxy resins.

* * * * *